United States Patent [19]

Nakamura

[11] Patent Number: 4,799,064

[45] Date of Patent: Jan. 17, 1989

[54] GYRATORY PARABOLIC ANTENNA DRIVING DEVICE

[75] Inventor: Kenichiro Nakamura, Shiga, Japan

[73] Assignee: Tsubakimoto Chain Company, Osaka, Japan

[21] Appl. No.: 43,143

[22] Filed: Apr. 27, 1987

[30] Foreign Application Priority Data

Apr. 30, 1986 [JP] Japan ..... 61-98171

[51] Int. Cl.[4] ..... H01O 3/04

[52] U.S. Cl. ..... 343/766; 343/761; 343/839

[58] Field of Search ..... 343/757, 758, 765, 766, 343/761, 839, 882

[56] References Cited

U.S. PATENT DOCUMENTS 4,626,864 12/1986 Micklethwaite ..... 343/766
4,672,385 6/1987 Prindle ..... 343/766
4,692,771 8/1987 Rothbarth et al. ..... 343/766

FOREIGN PATENT DOCUMENTS 60-187104 9/1985 Japan .
2120856 12/1983 United Kingdom ..... 343/765

*Primary Examiner*—William L. Sikes
*Assistant Examiner*—Doris J. Johnson
*Attorney, Agent, or Firm*—Dann, Dorfman, Herrell & Skillman

[57] ABSTRACT

A gyratory device for mounting a parabolic antenna on a base or frame in which the gyratory part includes a tubular stationary part receiving a motor and drive connections within the tubular part, a sleeve surrounding the tubular part. Adjustable arms are provided to adjust the axis of the gyratory part relative to the rotary axis of the earth and to adjust the angle of the antenna on the sleeve.

14 Claims, 5 Drawing Sheets

GYRATORY PARABOLIC ANTENNA DRIVING DEVICE

FIELD OF THE INVENTION

The present invention relates to a gyratory device which mounts a parabolic antenna on a base frame for adjustment to a desired position for the reception of satellite broadcasts.

BACKGROUND OF THE INVENTION

For tuning to and receiving signals from a satellite broadcasting station, it is necessary to adjust the direction of a parabolic antenna and for this purpose there have been proposed mounting devices which provide for driving the antenna to the proper position.

A conventional device has a linear actuator mounted between an antenna pole and the backside of the antenna, but this device is limited in the gyratory angle (approximately to 100°), thereby fails to cover all of the broadcasting satellites. In addition, the conversion of the linear motion of this device to rotary motion causes a large variation in the direction of movement in the travel of the actuator from between its opposite terminal ends, and thereby reduces the efficiency of the device.

On the other hand, various devices have been proposed which employ a rotary actuator, but such devices have problems in either maintenance or installation, or both. Where the rotary drive is exposed to the atmospheric conditions without suitable measures for sealing the rotary mechanism against rusting by rain or snow and intrusion of rainwater, there is also difficulty in providing adequate lubrication of the rotating parts. Furthermore, the prior devices of this type have presented problems in mounting the antenna directly to the gyratory shaft, for example, giving rise to problems such as a large overhang, power loss and deterioration in the rigidity of the mount.

A dual system type antenna support device has been proposed in Japanese laid-out patent application No. 187104/1985, which provides for independent adjustment of the face of the antenna in addition to gyratory movements. Since the axis of gyration is vertical, the adjustment of the angle of elevation of the face is necessitated after each gyratory movement. Consequently, the mechanism is difficult to adjust to properly focus on the satellite without complicated and expensive internal construction.

SUMMARY OF THE INVENTION

The present invention successfully solves the above-mentioned problems by providing a gyratory device for mounting a parabolic antenna of improved construction, which is provided with an outer sleeve rotatable relative to a stationary part and accommodating therein a motor in series with a reducing mechanism. Means are provided for mounting a parabolic antenna to the outer sleeve so that it is driven in gyratory movement by the output of the motor as reduced in the reducing mechanism.

DESCRIPTION OF THE PREFERRED EMBODIMENTS

Figure 1:
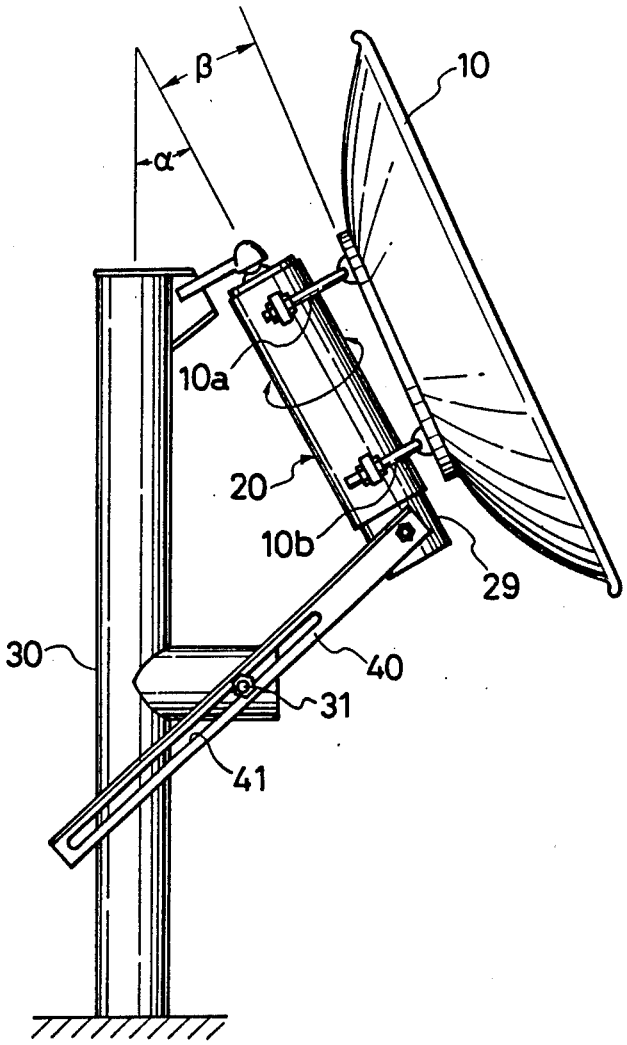
FIG. 1 is a side view of the gyratory device.

With reference to FIG. 1, an parabolic antenna 10 is mounted on a gyratory mounting part 20, which in turn is mounted on an earth-mounted frame or column 30. The gyratory mounting part 20 comprises a sleeve having a longitudinal axis which is inclined relative to the vertical at a selected angle $\alpha$. In the present instance, the column 30 is vertical and has at its upper end an outwardly-projecting arm terminating in a downwardly-facing socket which receives a ball projecting upwardly from the sleeve of the mounting part 20. The part 20 has an arm 40 pivoted to its lower end and extending toward the column 30 at an angle as shown. The arm is provided with a longitudinal slot 41 which is engaged by a bolt 31 mounted on the column 30. Loosening the bolt affords adjustment of the angle of elevation $\alpha$. The configuration of the slot and bolt support are such as to afford adjustment of the angle $\alpha$ between 0° and 90°, depending upon the latitude (e.g., 90° on the Equator and 0° at the North or South Pole). As described in more detail hereinafter, the antenna 10 is gyrated about the longitudinal axis of the mounting part 20 after the elevation angle $\alpha$ is selected and fixed by tightening bolt 31.

In order to control the gyratory movement of the antenna, the gyratory mounting part 20 accommodates a motor 21, reducing mechanisms 22 and 23, limit switches **29*a* and 29*b* for determining the limits of rotational angular movement, and a rotation sensor 22'-22''**. In order to afford stable positioning of the antenna, a brake is provided for self-retaining purposes.

Figure 2:
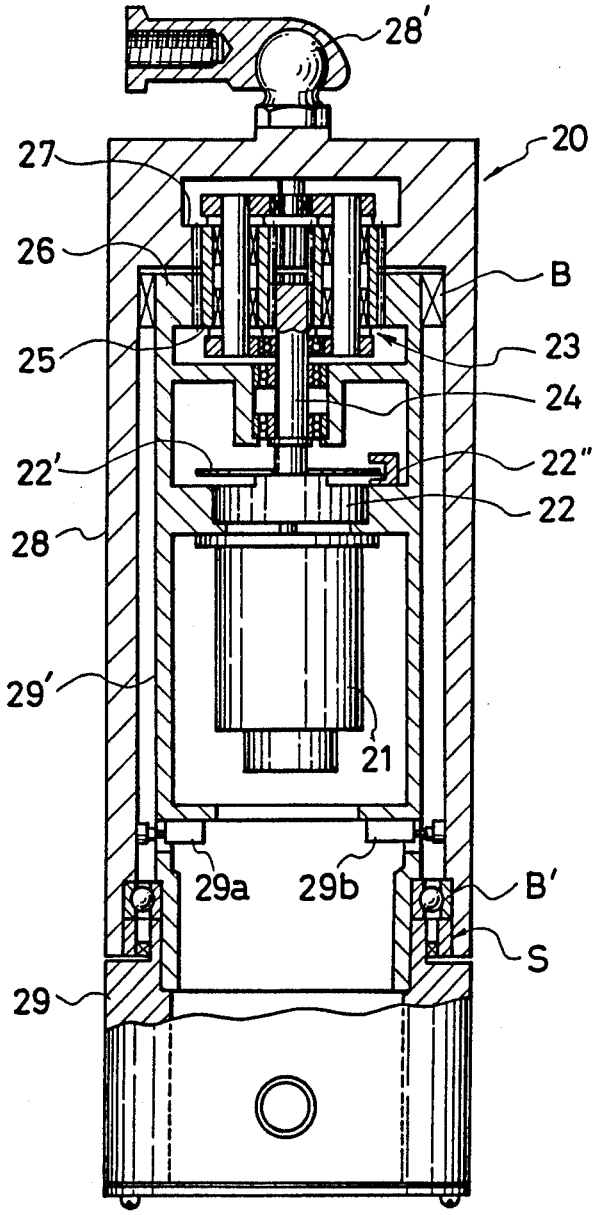
FIG. 2 is a sectional view through the sleeve showing the driving mechanism.

Referring now to to FIG. 2, the gyratory mounting part 20 comprises a stationary part 29 having a base on which the angular arm 40 is pivoted, and a tubular part 29' extending along the axis of the gyratory mounting portion 20. The tubular part 29√ houses a motor 21 which is preferably a d.c. motor with a built-in brake and reversing capability. The motor 21 drives gear-reducing mechanism 22 for transmitting power at a reduced rotary speed to an input shaft 24 of a planetary differential reducing mechanism mounted within the upper end of the tubular part 29' of the stationary part 29. The shaft 24 drives a second reducing mechanism 23 which is a planetary differental reducing mechanism. The output speed of the planetary differential mechanism 23 is dependent upon the speed differential between the internal ring gear 26 and the shaft 24 which causes the planet gears 25 to revolve around the axis at a substantially reduced rotational speed which is suitable for gyration of the antenna 10. The output of the differential mechanism is coupled to the sleeve 28 which is mounted coaxial with the tubular part 29' by a pair of anti-friction bearings B and B' on opposite sides of the motor 21 along the axis. An appropriate seal S is provided below the bearing B' to protect the internal parts of the gyratory part 20 from exposure to the elements of the outside atmosphere.

It is noted that the rotation of the sleeve 28 on the stationary part 29 is facilitated by the presence of a ball 28' projecting upwardly from the sleeve along the axis to engage in a socket extending out from the column as described above. The ball serves as a spherical bearing for the gyratory part relative to the support column, allowing both gyratory movement of the sleeve and adjustment of the elevation angle.

The motor 21 includes a controller which actuates the motor in response to signals from outside and signals from the sensor mechanism 22'-22'', and the limit switches **29*a* and 29*b*. Any suitable controller may be used, but the controller in the present case is provided with an electronic circuit to stop at a preset count of pulse signals from the outside. The sensor mechanism includes a slit plate 22' on the output of the first gear-reducing mechanism 22, and a photosensor or Hall element sensor 22'' to sense the rotation of the slit plate 22' and send pulses to the controller in a number commensurate with the motor rpm. The limit switches 29*a* and 29*b*** are located at the opposite gyratory end of positions of the sleeve relative to the central tubular part so as to arrest the rotary movement of the sleeve at the pre-set limits.

In FIG. 1, the parabolic antenna 10 is mounted on the sleeve 28 of the gyratory assembly 20 by threaded shafts **10*a* and 10*b* which pass through lugs on the sleeve and are adjustable on the lugs by a pair of cooperating nuts. In this fashion, the offset angle $\beta$ between the face of the antenna 10 and the axis of the sleeve 28** is adjusted to focus the antenna on the center of the satellite.

Figure 3:
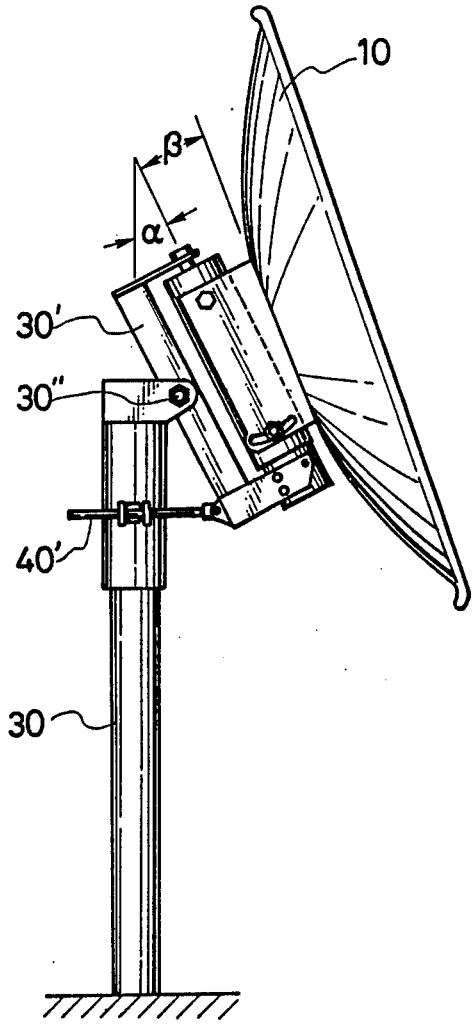
FIG. 3 is a view similar to FIG. 1 showing an alternate embodiment of the mounting device of the present invention.
Figure 4:
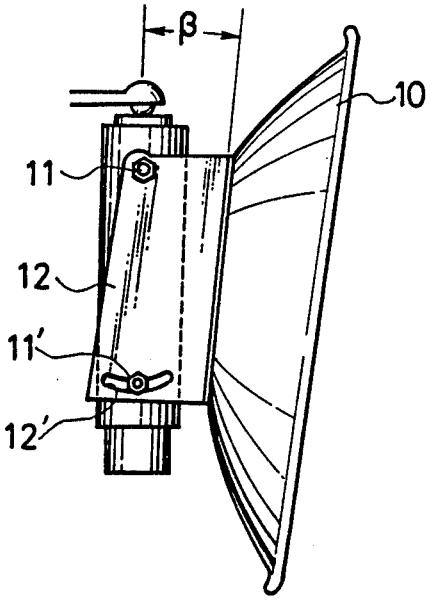
FIGS. 4 and 5 are fragmentary views showing alternate arrangements for mounting the antenna on the sleeve.

In FIG. 3, an alternate mounting arrangement is illustrated. In this case the gyratory part is mounted in a U-shaped frame 30' to afford gyration on the axis of the part. The frame 30' is pivotably mounted on the column 30 at a pivot point 30'' and the elevation angle $\alpha$ is adjusted by a threaded shaft 40' extending from the frame 30' to a lug on the column as shown.

various methods may be used for mounting the parabolic antenna on the gyratory device of the invention, as alternatives to the threaded shaft arrangement **10*a*, 10*b* shown in FIG. 1. In FIGS. 3 and 4, the antenna is mounted on the gyratory part by a U-shaped bracket 12 pivoted to the sleeve adjacent its upper end by bolts 11 and having an arcuate slot 12' at its lower end to accommodate locking bolts 11'** for angularly adjusting the offset angle $\beta$.

Figure 6:
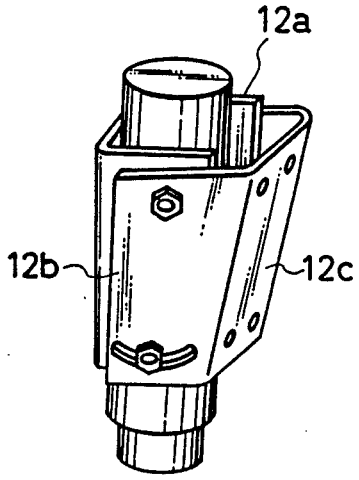
FIG. 6 is a fragmentary perspective view of the mounting arrangement shown in FIG. 5.
Figure 5:
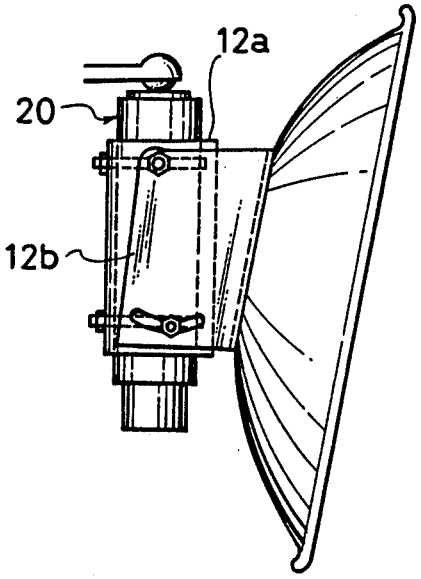

In FIGS. 5 and 6, a U-shaped bracket **12*a* is attached to the sleeve of the gyratory part 20 and a cooperating bracket 12*b* is attached to the antenna 10. The bracket 12*b* has an inclined surface 12*c* on which the antenna is mounted and the offset angle $\beta$ between the surface 12*c* and the axis of the gyratory part may be adjusted by adjusting the lower locking bolt which is mounted on the bracket 12*a* in the arcuate slot of the bracket 12*b***.

Thus, the mounting arrangement provides for adjustment of the elevation angle $\alpha$ and the offset angle $\beta$ to afford proper focusing of the parabolic antenna on a satellite.

Figure 7:
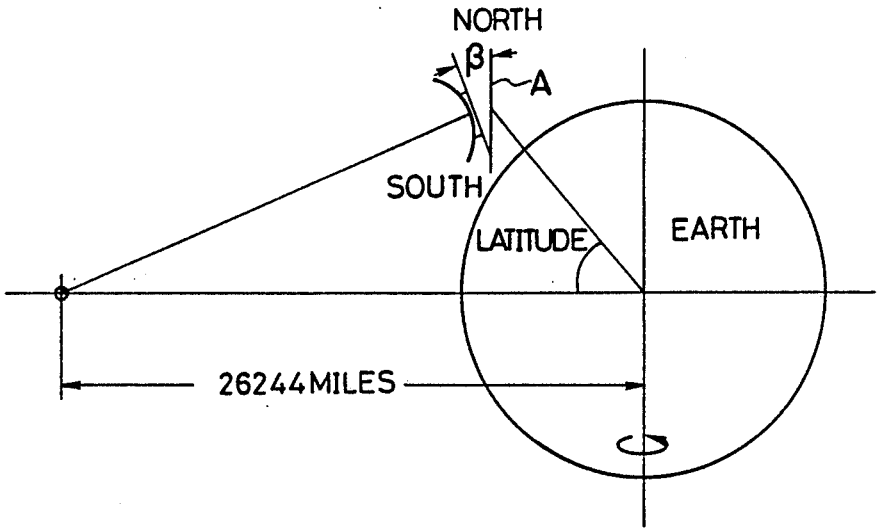
FIGS. 7 and 8 are diagrammatic views explanatory of the angular adjustments provided by the device of the present invention.
Figure 8:
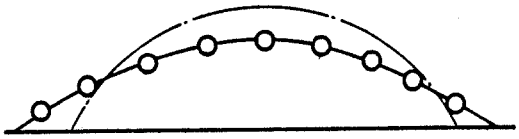

Referring to FIGS. 7 and 8, the angles are adjusted in the following manner when installing the antenna.

1. The gyratory axis A of the antenna is axially aligned coplanar with a north-south longitude of the earth of the mounting site.

2. The inclination of the gyratory axis A is adjusted according to the latitude of the site, so that the gyratory axis A is parallel to the rotational axis of the earth.

3. The offset angle $\beta$ between the gyratory axis A and the face of the antenna is adjusted to direct the antenna towards the center of the satellite.

Accordingly, the offset angle $\beta$ normally increases at greater latitudes.

In addition, the offset angle $\beta$ determines the locus of the antenna. As shown in FIG. 8, when the offset angle is 0, the antenna draws an arcuate locus as indicated by the chain line in FIG. 8. As the offset angle increases, the locus is altered into a flat elliptical form as indicated by the solid line in FIG. 8 so as to catch the orbit of the satellite in a more reliable manner. The offset angle is normally adjusted approximately in the range of 0° to 10°.

By reason of the foregoing arrangements, the following effects are achieved.

1. Since the gyratory movement is effected on the elevation angle, there is no need for adjusting the angle of elevation for each gyration.

2. The gyratory driving parts are encassed in the tubular stationary part and are compactly arranged therein.

3. Since the sleeve has its axis on the elevation angle, the antenna can be mounted directly on the sleeve to simplify the construction.

4. The use of a rotary motor enables the mount to gyrate through a greater angle as compared to a device using a linear actuator.

5. The driving parts are housed in a integral tubular casing to ensure complete protection against rainwater.

6. The device can be attached to various kinds of antennas simply by changing the bracket to one having a proper mounting surface.

While various embodiments of the invention have been herein illustrated and described, it is not intended to limit the invention to the precise embodiments but changes and modifications may be made therein and thereto within the scope of the following claims.

I claim:

1. A gyratory device for mounting a parabolic antenna on a base frame comprising a stationary hollow housing adapted to be mounted on said frame a motor assembly mounted coaxially with said housing, a coaxial sleeve part mounted for rotation about its longitudinal axis on said stationary housing and enclosing said motor assembly, the outside of said housing and the inside of said sleeve being cylindrical, at least two anti-friction bearings positioned between the outside of said housing and the inside of said sleeve at spaced axial locations, said motor assembly being positioned within said hollow housing between said locations, means mounting said parabolic antenna on said sleeve, and driving connections from said motor assembly to said sleeve to rotate said sleeve on its axis and thereby the antenna upon actuation of said motor.

2. A gyratory device according to claim 1 wherein said motor assembly comprises a reversible motor having a rotary shaft, and speed-reducing gears coupling said motor to said shaft whereby said shaft is driven at a reduced speed relative to said motor, said driving connections operable to couple said shaft to said sleeve.

3. A gyratory device according to claim 2 wherein said driving connections comprise a speed-reducing differential planetary gear train.

4. A gyratory device according to claim 2 including a sensor to detect the rotation of said shaft and operable to control the actuation of said motor.

5. A gyratory device according to claim 4 including limit switches operable to switch off the actuation of said motor, said limit switches being positioned at opposite end positions of the rotary travel of said sleeve.

6. A gyratory device according to claim 1 wherein said frame is Earth-mounted and said stationary part is mounted on said frame with the axis of the sleeve coplanar with a north-south Longitude line and inclined at a preselected elevation angle to the vertical between 0° and 90°, depending on the Latitude, so as to be parallel to the rotational axis of the Earth.

7. A device according to claim 6 including a pivotal mounting between said gyratory device and said frame and an adjusting arm to fix said device on said pivotal mounting at the selected elevation angle.

8. A device according to claim 7 wherein said pivotal mounting includes a ball-and-socket joint between said gyratory device and said frame and a slot and anchor connection between said adjusting arm and said gyratory device.

9. A device according to claim 6 wherein said antenna-mounting means includes a pivotal axle perpendicular to the longitudinal axis of the sleeve to afford pivotal adjustment of the antenna relative to the sleeve, and locking means to fix the pivotal position of said antenna on said sleeve at a selected offset angle.

10. A device according to claim 9 wherein said antenna-mounting means includes a bracket mounted at one end on said pivotal axle and supported at the other end by said locking means, said bracket adapted to mount one of a plurality of antennas having different configurations.

11. A gyratory device for mounting a parabolic antenna on a base frame, comprising an elongated stationary housing having a longitudinal axis inclined relative to the vertical means pivotally supporting said housing at the top and adjustable connections at the bottom of said housing mounting the housing on said frame to adjust the inclination of said axis, the pivotal support means at the top of the housing including a ball and socket joint, a motor assembly mounted on said stationary housing, an elongated sleeve part mounted for rotation about its longitudinal axis on said stationary housing, said sleeve being closed at the top and mounting said ball and socket joint, said sleeve engaging over said housing and enclosing said motor assembly, means at the top and bottom of said sleeve mounting said parabolic antenna on said sleeve with the center of the antenna centered between said top and bottom means, and driving connections between said top and assembly to said sleeve to rotate said sleeve on its axis and thereby the antenna upon actuation of said motor.

12. A gyratory device according to claim 11 wherein said top and bottom mounting means are adjustable to afford adjustment of the face of the antenna relative to said axis.

13. A gyratory device according to claim 11 wherein said motor has a rotary axis coaxial with the longitudinal axis of said housing and is centered between said top and bottom mounting means.

14. A gyratory device for mounting a parabolic antenna on an earth-mounted base frame comprising a stationary housing adapted to be pivotally mounted on said frame at a preselected elevation angle so as to be parallel to the rotational axis of the earth, a motor assembly mounted coaxially with said housing, a coaxial sleeve part mounted for rotation about its longitudinal axis on said stationary housing and enclosing said motor assembly, means mounting said parabolic antenna on said sleeve, driving connections from said motor assembly to said sleeve to rotate said sleeve on its axis and thereby the antenna upon actuation of said motor, the pivotal mounting for said housing including a ball-and-socket joint between said housing and said frame, an adjusting arm to fix said housing at said preselected angle, and an adjustable anchor connection for said adjusting arm to afford adjustment of said preselected angle.

* * * * *

UNITED STATES PATENT AND TRADEMARK OFFICE

CERTIFICATE OF CORRECTION

PATENT NO. : 4,799,064

DATED : January 17, 1989

INVENTOR(S) : Kenichiro Nakamura

It is certified that error appears in the above-identified patent and that said Letters Patent is hereby corrected as shown below:

Col. 1, line 21, "fails" should be --failing--;

Col. 1, line 59, "are" should be --is--;

Col. 2, line 49, "29√" should be --29'--;

Col. 4, line 46, insert a comma (,) after "frame";

Col. 6, line 12, delete "between said top and" and insert --from said motor--.

Signed and Sealed this

Ninth Day of May, 1989

*Attest:*

DONALD J. QUIGG

*Attesting Officer*

*Commissioner of Patents and Trademarks*